United States Patent [19]

Harris

[11] 4,316,613

[45] Feb. 23, 1982

[54] SKILL MARBLE GAME

[76] Inventor: Virgil W. Harris, R.R. 17, Box 245, Brazil, Ind. 47834

[21] Appl. No.: 170,909

[22] Filed: Jul. 21, 1980

[51] Int. Cl.[3] ..... A63B 63/08

[52] U.S. Cl. ..... 273/401

[58] Field of Search ..... 273/401, 402, 357, 399, 273/400

[56] References Cited

U.S. PATENT DOCUMENTS 566,134 8/1896 Boffat ..... 273/402

602,187 4/1898 Renwick ..... 273/357

3,201,125 8/1965 Vensel ..... 273/401

*Primary Examiner*—Paul E. Shapiro

*Attorney, Agent, or Firm*—Woodard, Weikart, Emhardt & Naughton

[57] ABSTRACT

A skill marble game wherein a plurality of marbles are dropped into apertures provided in a container. The container has a curved top wall with a convex upwardly facing surface with a plurality of apertures extending therethrough. The apertures are circular in configuration although some appear elliptical when viewed from a location above the container.

7 Claims, 2 Drawing Figures

SKILL MARBLE GAME

BACKGROUND OF THE INVENTION

This invention is in the field of games. The game disclosed herein is a game of skill which requires the player to drop a number of spheres or marbles through apertures provided in a container. The game is an improvement over prior games in that the apertures provide apparent different sizes when viewed from above.

A number of U.S. patents have been granted on games utilizing combinations of marbles and containers. The U.S. Pat. No. 1,606,339 issued to H. Brate discloses a game board having an aperture wherein marbles are moved therethrough by the action of a mallet. U.S. Pat. No. 1,436,962 issued to A. E. Kaiser discloses a game container into which a plurality of marbles are rolled through doors. Other U.S. patents disclosing combinations of spheres or discs with game boards include U.S. Pat. No. 1,519,850 issued to W. H. Lautzenheiser, U.S. Pat. No. 3,647,215 issued to Helen Sterlicchi et al. and U.S. Pat. No. 3,647,216 issued to J. D. Breslow.

In addition to the apparent size differences between the apertures receiving the marbles in the game disclosed herein, the inside surface of the top wall is concave guiding the spheres within the container toward the aperture as the container is inverted thereby facilitating the removal of the spheres from the container.

SUMMARY OF THE INVENTION

One embodiment of the present invention is a game of skill comprising a plurality of spheres of equal diameter, and a closed container with a bottom wall configured to support the container upon a flat surface, the container including a top wall with a plurality of apertures, the apertures each have a size larger than the equal diameters of the spheres allowing the spheres to pass through the apertures into the container when dropped one at a time from a position over the apertures, the top wall including an inwardly facing concave surface guiding the spheres when positioned inside the container to roll toward the apertures as the container is inverted.

It is an object of the present invention to provide a new and improved game of skill.

A further object of the present invention is to provide a game of skill wherein marbles are dropped through apertures in a box with the apertures having visually apparent different sizes.

Yet another object of the present invention is to provide a skill marble game having a concave interior top wall guiding marbles within the container toward exit apertures as the container is inverted.

Related objects and advantages of the present invention will be apparent from the following description.

DESCRIPTION OF THE PREFERRED EMBODIMENT

Figure 1:
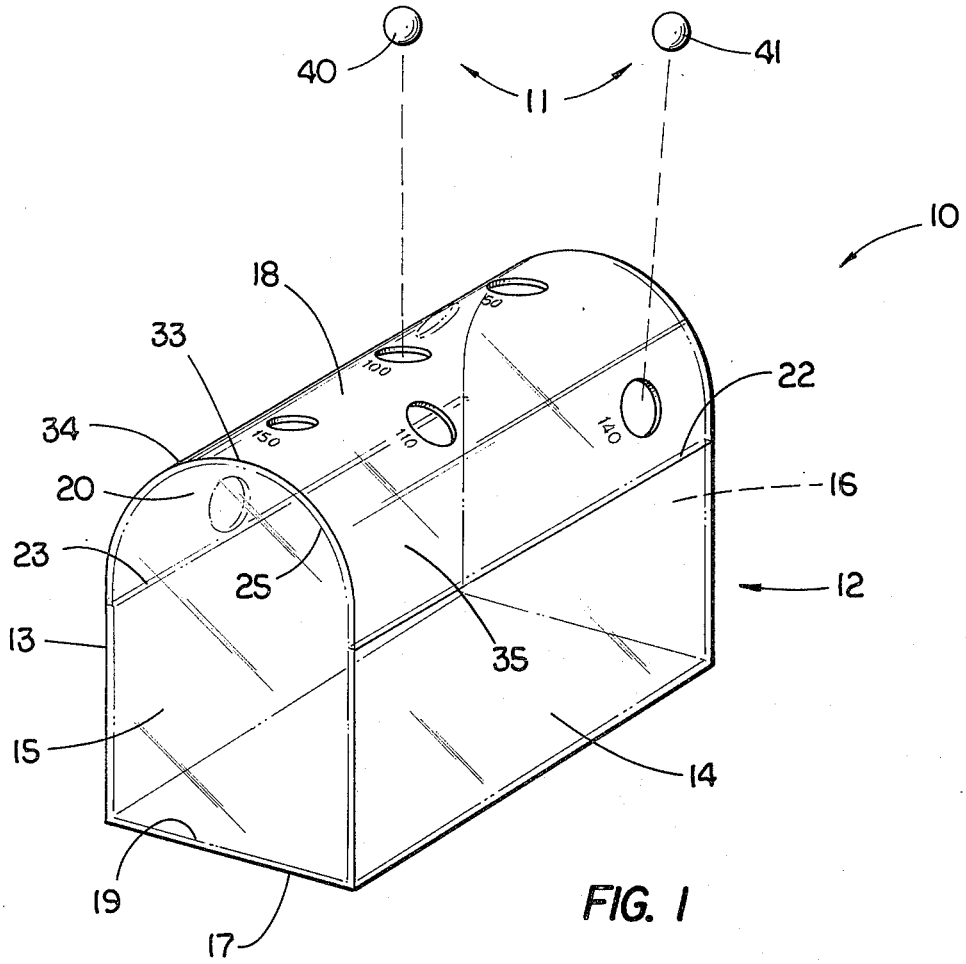
FIG. 1 is a perspective view of the game of skill incorporating the present invention including a plurality of spheres droppable into the shown container.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a game 10 of skill including a plurality of spheres or marbles 11 which are droppable through apertures provided in the top wall of a closed container 12. Container 12 includes a pair of parallel side walls 13 and 14 joined to a pair of end walls 15 and 16 in a rectangular configuration. All four walls 13 through 16 are mounted atop and are sealingly joined to a bottom flat wall 17. A semicircular top wall 18 is mounted atop and joined to the top edges of walls 13 through 16.

Walls 15 and 16 are identical having a lower straight edge 19 and a semicircular top edge portion 20 with the outer circumferential edge of semicircular portion 20 being joined to the semicylindrical edge portion of the adjacent top wall 18. Likewise, top wall 18 includes a pair of parallel and lengthwise extending straight edges 22 and 23 which are mounted atop and secured to the top edge, respectively of side walls 14 and 13. The opposite edge portions of top wall 18 extend across the width of the container which has a resemblance to a rural mailbox.

The object of the game is to drop spheres, one at a time, through the various apertures provided in the top wall of the container which is supported upon a flat surface by bottom wall 17. Once the spheres or marbles are dropped into the container, the container may be inverted with the marbles then falling onto the concave surface 25 of the top wall with the concave surface guiding the marbles toward the apertures as the container is turned allowing the marbles to eventually fall from the container.

Figure 2:
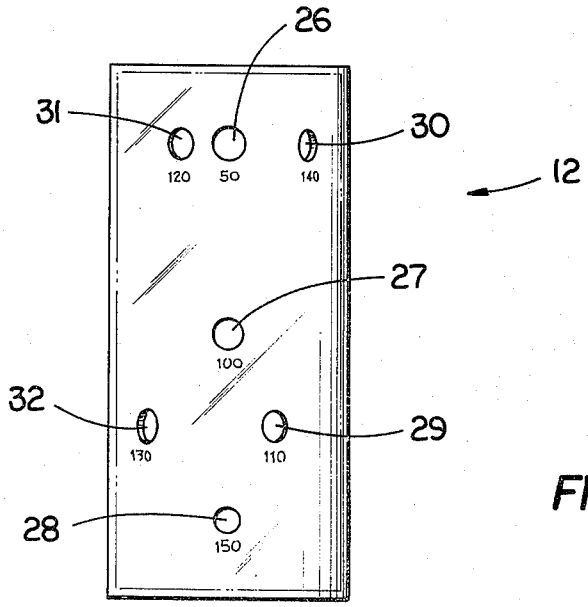
FIG. 2 is a top plan view of the container of FIG. 1.

The semicylindrical configured top wall 18 is shown as having seven apertures extending therethrough; however, it is to be understood that the number of apertures may increased or decreased as desired. Three of the apertures 26, 27 and 28 are located at the peak portion 33 of the wall which is that portion of the wall which extends the length of the container and is positioned the greatest distance from bottom wall 17. As viewed in FIG. 1, the left portion 34 of top wall 18 slopes downwardly to the left from the peak portion 33. Likewise, the right portion 35 of the top wall slopes downwardly and to the right from the peak portion or ridge 33. Apertures 29 and 30 are shown as located in the downwardly sloping right portion 35 whereas apertures 31 and 32 are located in the left downwardly sloping portion 34 of the top wall. All seven of the apertures 26 through 32 are circular with each aperture having a diameter greater than the marbles or spheres 11. When viewed from directly overhead as shown in FIG. 2, apertures 26 through 28 have a visual circular appearance whereas apertures 29 through 32 appear to be elliptical when viewed from overhead; however, it is understood that apertures 29 through 32 are actually circular in configuration. Apertures 27 and 29 through 32 have the exact same diameter. It can therefore be appreciated that it is easier to drop a marble through aperture 27 as compared to dropping the same marble through apertures 29 through 32 due to the elliptical appearance as a result of the apertures being located on the downwardly sloping top wall with the marble being dropped from an overhead position. To increase the amount of skill required to play the game, aperture 28 has a diameter smaller than aperture 27 whereas aperture 26 has a diameter slightly larger than aperture 27. It can therefore be appreciated that it is relatively easier to drop the same marble through aperture 26 as compared to aperture 27 or aperture 28. Indicia or scoring means is provided on the outer surface of top wall 18 immediately adjacent to each aperture with a preselected scoring value assigned to each aperture. The indicia means is shown as the printed numbers 50, 100, 110, 120, 130, 140 and 150 shown as positioned immediately adjacent apertures 26, 27, 29, 31, 32, 30 and 28, respectively. The higher the scoring value associated with each aperture, the more difficult it is to drop a marble through the respective aperture. The outwardly facing convex surface of top wall 18 further increases the skill since the wall will deflect the marble away from the aperture unless the marble is dropped directly through the aperture.

As shown in FIG. 2, apertures 26 through 28 on the peak portion 33 of the top wall are of different diameters relevant to each other; with aperture 26 having a diameter less than one-eighth of an inch larger than the equal diameter of the spheres 11. Aperture 29 is actually equal in size to aperture 30 but appears larger than aperture 30 due to its more proximate location to peak 33. Aperture 32 is actually greater in size relative to aperture 31 but appears from a point directly overhead as equal in size to aperture 31 due to its more distant location from peak 33. Two marbles 40 and 41 are shown in FIG. 1; however, it should be understood that additional marbles are used when playing game 10. Aperture 27 is located centrally on top wall 18 being located midway between the opposite widthwise extending edges and midway between the lengthwise extending edges.

Container 10 may be produced from a variety of materals. For example, all of the walls of the container may be produced from a transparent plastic material. Alternatively, the walls may be produced from non-transparent plastic material. It will be obvious from the above description that the present invention provides a new and improved skill marble game. It will be further obvious that an advantage of the game of skill disclosed herein is the object of dropping marbles into apertures, some having equal diameters but apparent visually different diameters.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A game of skill comprising:

a plurality of spheres of equal diameter; and a closed container with a bottom wall configured to support said container upon a flat surface, said container including a top wall with an aperture, said aperture has a size larger than said equal diameters of said spheres allowing said spheres to pass through said aperture into said container when dropped one at a time from a position over said aperture, said top wall including an inwardly facing concave surface guiding said spheres when positioned inside said container to roll toward said aperture as said container is inverted and wherein said top wall is semicylindrical in configuration with said aperture centrally located thereon, said container includes a pair of side walls and a pair of end walls joined together in a rectangular configuration and joined to said bottom wall which has a flat configuration, said top wall includes a pair of lengthwise extending parallel and straight edges joined to said side walls and a pair of curved widthwise extending edges, said end walls each include a semicircular end portion joined to said curved widthwise extending edges.

2. The game of claim 1 wherein said aperture has a diameter less than one-eighth of an inch larger than said equal diameter of said spheres.

3. The game of claim 2 wherein said container is of a transparent plastic construction.

4. A game of skill comprising:

a plurality of spheres of equal diameter; and a closed container with a bottom wall configured to support said container upon a flat surface, said container including a top wall with an aperture, said aperture has a size larger than said equal diameters of said spheres allowing said spheres to pass through said aperture into said container when dropped one at a time from a position over said aperture, said top wall including an inwardly facing concave surface guiding said spheres when positioned inside said container to roll toward said aperture as said container is inverted; and wherein said top wall includes an outwardly facing convex surface part forming a peak portion and part forming downwardly sloping portions extending from said peak portion, said top wall includes a plurality of apertures extending therethrough all having a diameter greater than said spheres with some of said apertures being located on said peak portion and appearing circular when viewed directly overhead whereas other of said apertures being located on said downwardly sloping portions appearing elliptical in configuration when viewed directly overhead of said container; and further comprising: indicia means on said container operably indicating a preselected scoring value assigned to each aperture.

5. The game of claim 4 wherein said convex surface has different slopes at different distances from said peak portion, some of said apertures on said peak portion are of different diameters relative to each other, said apertures of one of said downwardly sloping portions are of equal size relative to each other and are located on said convex surface at said different distances to appear of unequal size relative to each other when viewed directly overhead, said apertures on another of said downwardly sloping portions are of unequal size relative to each other and are located on said convex surface at said different distances to appear to be of equal size relative to each other when viewed directly overhead.

6. The game of claim 4 wherein said top wall is semicylindrical in configuration.

7. The game of claim 6 wherein said container includes a pair of side walls and a pair of end walls joined together in a rectangular configuration and joined to said bottom wall which has a flat configuration, said top wall includes a pair of lengthwise extending parallel and straight edges joined to said side walls and a pair of curved widthwise extending edges, said end walls each include a semicircular end portion joined to said curved widthwise extending edges.

* * * * *